US009004610B2

(12) United States Patent
Erdmann et al.

(10) Patent No.: US 9,004,610 B2
(45) Date of Patent: Apr. 14, 2015

(54) QUICK-CHANGE TOOL HOLDER SYSTEM FOR A CUTTING TOOL

(75) Inventors: Peter Erdmann, Emmelshausen (DE); Steffen Wachsmann, Koblenz (DE); Niels Laugwitz, Lahnstein (DE); Karl-Hermann Moetz, Munich (DE)

(73) Assignee: BOMAG GmbH, Boppard (DE)

( * ) Notice: Subject to any disclaimer, the term of this patent is extended or adjusted under 35 U.S.C. 154(b) by 176 days.

(21) Appl. No.: 13/226,682

(22) Filed: Sep. 7, 2011

(65) Prior Publication Data

US 2012/0068527 A1 Mar. 22, 2012

(30) Foreign Application Priority Data

Sep. 7, 2010 (DE) ..... 10 2010 044 649

(51) Int. Cl.
*B28D 1/18* (2006.01)
*E21C 35/19* (2006.01)

(52) U.S. Cl.
CPC ..... *B28D 1/188* (2013.01); *E21C 2035/191* (2013.01)

(58) Field of Classification Search
CPC ..... E21C 2035/191
USPC ..... 299/102, 106
See application file for complete search history.

(56) References Cited

U.S. PATENT DOCUMENTS

| | | | | |
|---|---|---|---|---|
| 2,242,808 | A * | 5/1941 | Austin | 404/121 |
| 4,335,921 | A * | 6/1982 | Swisher et al. | 299/103 |
| 4,343,516 | A * | 8/1982 | Aden | 299/106 |
| 5,040,850 | A * | 8/1991 | Komotzki | 299/106 |
| 6,508,516 | B1 * | 1/2003 | Kammerer | 299/104 |
| 7,730,645 | B2 * | 6/2010 | Ollinger, IV | 37/328 |
| 2008/0223744 | A1 | 9/2008 | Tewes et al. | |

FOREIGN PATENT DOCUMENTS

| | | | |
|---|---|---|---|
| DE | 31 17 639 | A1 | 8/1982 |
| DE | 88 05 961 | U1 | 6/1988 |
| DE | 39 09 425 | C1 | 8/1990 |
| DE | 295 10 913 | U1 | 9/1995 |
| DE | 10 2004 030 691 | A1 | 1/2006 |
| DE | 10 2005 017 760 | A1 | 10/2006 |
| DE | 10 2009 052 351 | A1 | 5/2011 |

OTHER PUBLICATIONS

European Patent Office, EPO Machine Translation of DE102005017760A1, Published on Oct. 19, 2006, retrieved from http://worldwide.espacenet.com/publicationDetails/biblio?DB=worldwide.espacenet.com&I (9 pages).

European Patent Office, EPO Machine Translation of DE8805961U1, Published on Jun. 23, 1988, retrieved from http://worldwide.espacenet.com/publicationDetails/biblio?DB=worldwide.espacenet.com&I (5 pages).

(Continued)

*Primary Examiner* — John Kreck

(74) *Attorney, Agent, or Firm* — Wood, Herron & Evans, LLP

(57) ABSTRACT

The present invention relates to a quick-change tool holder system, comprising a base part with a quick-change tool holder receptacle and a quick-change tool holder having a cutting tool receptacle configured for insertion into the quick-change tool holder receptacle.

14 Claims, 6 Drawing Sheets

(56) References Cited

OTHER PUBLICATIONS

European Patent Office, EPO Machine Translation of DE3117639A1, Published on Aug. 12, 1982, retrieved from http://worldwide.espacenet.com/publicationDetails/biblio?DB=worldwide.espacenet.com&I (5 pages).
European Patent Office, EPO Machine Translation of DE102009052351A1, Published on May 12, 2011, retrieved from http://worldwide.espacenet.com/publicationDetails/biblio?DB=worldwide.espacenet.com&I (5 pages).
European Patent Office, EPO Machine Translation of DE102004030691A1, Published on Jan. 19, 2006, retrieved from http://worldwide.espacenet.com/publicationDetails/biblio?DB=worldwide.espacenet.com&I (5 pages).
European Patent Office, European Search Report, Application Serial No. EP11007139.6, dated Dec. 22, 2011 (7 pages).

* cited by examiner

Fig. 1
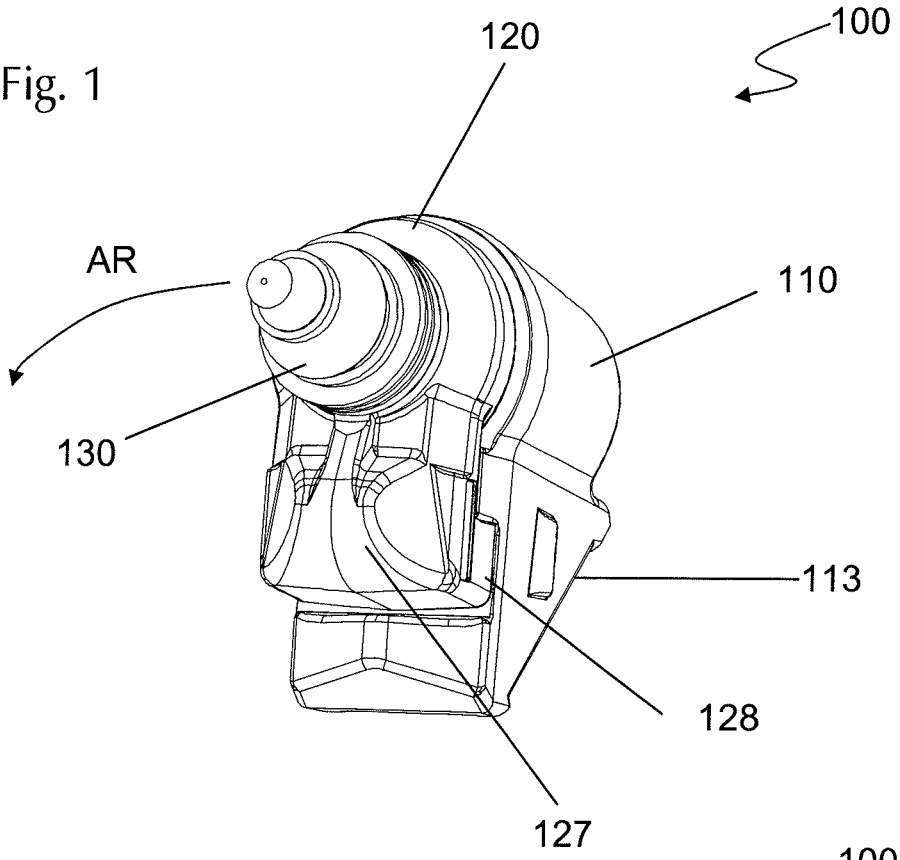
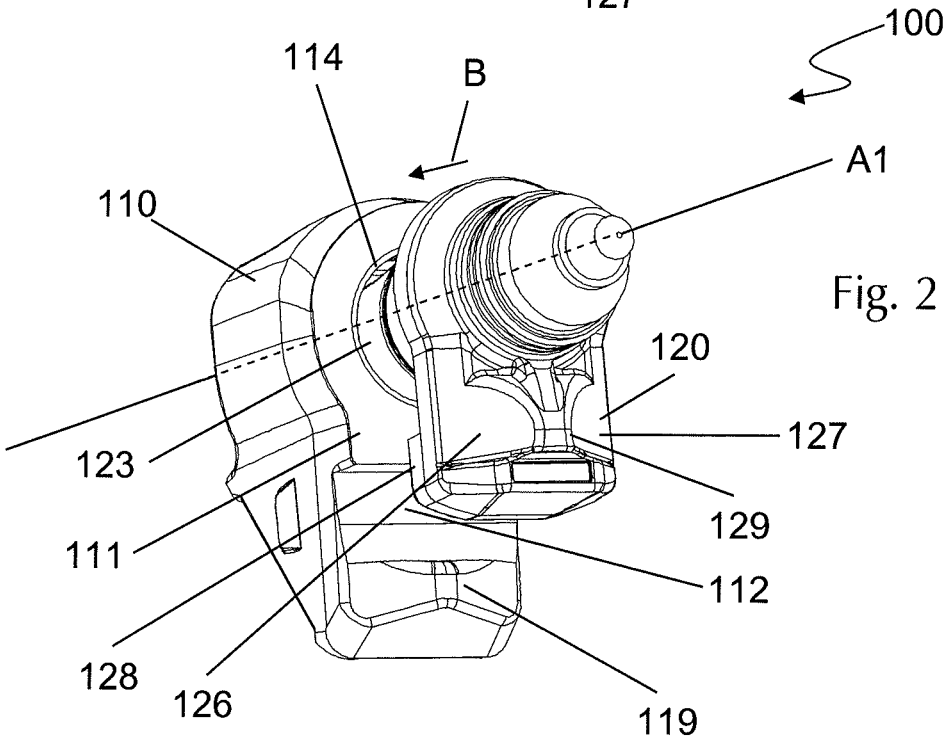
Fig. 2

QUICK-CHANGE TOOL HOLDER SYSTEM FOR A CUTTING TOOL

The present application claims priority under 35 U.S.C. §119 of German Patent Application No. 10 2010 044 649.1, filed Sep. 7, 2010, the disclosure of which is hereby incorporated herein by reference in its entirety.

FIELD OF THE INVENTION

The present invention relates to a quick-change tool holder system, comprising a base part and a quick-change tool holder configured to be held in the base part having a cutting tool receptacle for receiving and mounting a cutting tool, in particular a round-shank pick.

BACKGROUND OF THE INVENTION

A frequent area of use of generic quick-change tool holder systems is their use in machines for ground preparation, especially in road construction. This frequently involves machines having a driven roller rotatable about a horizontal axis, on which a plurality of ground preparation tools, in particular cutting tools and especially round-shank picks, are arranged. Such machines comprise, for example, stabilisers, recyclers and road millers, in particular cold millers. During working operation, the holders for receiving the cutting tools, in particular round-shank picks, are exposed to high stress levels and extremely high wear, on the one hand due to the broken material in the milling box and on the other hand due to the rotating round-shank pick, in particular in the area of the tool shank receiving bore in the tool holder and the contact surface of a wear disk which is possibly provided. Furthermore, the tool holder becomes worn or destroyed when the tool breaks off, falls out or is worn down. In order to be able to renew the worn or destroyed components of the tool holder easily and rapidly, the use of so-called quick-change tool holder systems has become established.

The essential components of such a quick-change tool holder system are a base part and a quick-change tool holder connected to the base part, which is configured for receiving a tool for ground preparation, for example, a cutting tool, in particular a round-shank pick. The base part is fastened firmly on the cylindrical outer surface of the milling roller which is usually mounted horizontally and perpendicular to the working direction of a corresponding construction machine, for example, by firmly welding the base part on the roller body. The base part therefore forms the element linking the quick-change tool holder system to the roller base body. The base part is further used for mounting the quick-change tool holder system or is configured for mounting the quick-change tool holder system. To this end, a quick-change tool holder receptacle is provided in the base part, which for example can comprise a suitable receiving bore in the usually compactly configured base part. The quick-change tool holder also comprises a comparatively compact element. The quick-change tool holder can be reversibly mounted on the base part and for this reason, for example, has corresponding threads, clamping pins and/or screw holes, etc. A defective quick-change tool holder can therefore be exchanged rapidly, without needing to separate the base part from the roller body for this purpose. The quick-change tool holder is further configured for receiving the cutting tool, in particular a round-shank pick, and for this purpose has a corresponding tool receptacle, for example a cutting tool receptacle in the form of a cylindrical receiving channel provided for receiving and mounting the cutting tool. Round-shank picks are frequently mounted rotatably about their cylinder axis in the quick-change tool holder and are secured against any axial displacement by suitable clamping means, for example, a clamping sleeve. The advantage of the quick-change tool holder system is that in the event of a defective tool, it is possible to selectively replace the tool and/or the quick-change tool holder without the fixed connection of the base part to the roller body needing to be expensively released and then remade again.

Although generic quick-change tool holder systems have in principle already proved successful, there is still need for improvement. This relates in particular to exchanging the machining tool and/or the quick-change tool holder and the robustness of the entire quick-change tool holder. It is therefore the object of the present invention to provide a quick-change tool holder system that enables an easier exchange of the quick-change tool holder on the base part and at the same time has an increased robustness.

SUMMARY OF THE INVENTION

In one aspect of the present invention, a quick-change tool holder system according to the present invention comprises a base part with a quick-change tool holder receptacle and a supporting projection and a quick-change tool holder configured for insertion into the quick-change tool holder receptacle having a cutting tool receptacle, wherein the quick-change tool holder comprises a bearing body and a base gripping part which protrudes in the radial direction relative to the direction of insertion of the quick-change tool holder in the base part and which projects in the direction of insertion, which grips the supporting projection on the base part in the inserted state. This embodiment and the further developments attributed to this will subsequently be designated as "insertion variant".

In the insertion variant, the quick-change tool holder can thus be inserted into the base part and is held by the base part. At the same time, it is advantageous if the quick-change tool holder can be inserted into the base part from obliquely above or roughly in the direction in which the cutting tool is loaded subsequently during working operation. The direction of insertion of the quick-change tool holder in the quick-change tool holder receptacle of the base part is therefore preferably roughly opposite to that direction in which the cutting tool inserted into the cutting tool receptacle projects outwards in the direction of its longitudinal axis over the quick-change tool holder. The bearing body usually has an elongate shape along a longitudinal axis. At least the part of the bearing body inserted into the base part can, for example, be cylindrical or conical. The longitudinal axis of the bearing body then corresponds to the cone or the cylinder axis of this region. The insertion movement preferably comprises a substantially linear movement by which means the quick-change tool holder is inserted into the base part into its end position. The quick-change tool holder and the base part are in other words configured with respect to one another such that the quick-change tool holder can be inserted into the base part. In the inserted state the quick-change tool holder is held by the base part and projects at least partially into the correspondingly configured quick-change tool holder receptacle of the base part with a fitting region of the bearing body in the direction of insertion. The quick-change tool holder therefore abuts at least with the fitting region against the base part in the inserted state. At the same time, the bearing body of the quick-change tool holder is used for receiving and mounting the cutting tool. The cutting tool receptacle is therefore also part of the bearing body. The cutting tool receptacle is preferably configured as a hollow-cylindrical bore in which a round-shank pick can be rotatably mounted. The cylinder axis of this cutting tool receptacle therefore preferably lies coaxially to the longitudinal axis of the quick-change tool holder receptacle in the base part in the inserted state of the quick-change tool holder in the base part.

Another essential feature of the quick-change tool holder is furthermore the base gripping part. The base gripping part fulfils on the one hand a supporting function and on the other hand a protecting function. The base gripping part is in principle configured in such a manner that it overlaps and embraces a part of the base part in the direction of insertion. The embracing is accomplished in such a manner that the base gripping part grips behind the supporting projection from the point of view of the longitudinal axis of the quick-change tool holder in a hook-like manner. In this region the quick-change tool holder covers the base part with its base gripping part coming from the direction of insertion of the quick-change tool holder and protects it towards the outside. Overall the base gripping part enables the quick-change tool holder to be additionally supported on the base part, at least in the severely stressed state, and in this way, for example, relieves the stress on the bearing body of the quick-change tool holder. This particularly relates to forces acting at least partially obliquely and in particular perpendicularly to the direction of insertion of the quick-change tool holder on the cutting tool or on the quick-change tool holder. The base gripping part therefore enables a particularly advantageous absorption of force by the quick-change tool holder system when the quick-change tool holder system is subjected to forces, for example, during working operation. Specifically, the base gripping part comprises a component projecting from the base body. In relation to the longitudinal axis of the bearing body, the base gripping part projects in particular in the radial direction over the bearing body, preferably towards the underside of the base part with which the base part is fastened on the roller. In principle, the base gripping part can comprise an independent component which is connected to the bearing body, for example, by means of a screw or welded connection. However, it is preferable to manufacture the quick-change tool holder as a solid component, for example as a forged or cast part, so that the bearing body and the base gripping part of the quick-change tool holder are formed in one piece. With the aid of the base gripping part it is possible for the quick-change tool holder to be additionally secured in its position with respect to the base part in the state inserted in the base part and a more favourable absorption of force is obtained. In particular, the base gripping part makes it possible to relieve the stress in particular on the bearing body of the quick-change tool holder. Since the base gripping part comes into engagement with the supporting projection or grips this during insertion of the quick-change tool holder into the quick-change tool holder receptacle of the base part ("direction of insertion"), a type of forced guidance is further achieved by the base gripping part and the supporting projection by which means the relative positioning of the quick-change tool holder to the base part is secured.

The counterpart to the base gripping part on the base part is formed by the supporting projection which is part of the base part. The supporting projection is preferably also configured as solid with the other base part but can in principle also be present as an independent component. The supporting projection further rests on the outer side of the base part so that the inserted base gripping part of the quick-change tool holder can embrace this in the inserted state and, at least in the severely stressed state, can be supported on this with the base gripping part. Embracing designates in the present case a configuration of the base gripping part of the quick-change tool holder to the effect that the base gripping part is placed over the supporting projection in such a manner that it shields the base gripping part in the radial direction relative to the longitudinal axis of the bearing body on both sides and contrary to the direction of insertion and, as will be explained in further detail hereinafter, comes into contact at least partially and in particular completely with this region. The base gripping part therefore, for example, has an approximately U-shaped profile with a projecting gripping arm. Embracing therefore does not conversely mean that the gripping part completely embraces the supporting projection. Embracing rather relates to the direction of insertion of the quick-change tool holder in the base part and the base gripping part embraces the supporting projection in such a manner that through its embracing of the supporting projection, the base gripping part makes it possible to support the quick-change tool holder on the base part under stress in the direction of insertion and/or in the radial direction to the direction of insertion and/or obliquely to these directions. The base gripping part is further configured in such a manner that it is at least partially open towards the direction of insertion and can be inserted during mounting into its position embracing the supporting projection. Conversely, the supporting projection should be configured in such a manner on the base part that the base gripping part can be placed or pushed over it in the direction of insertion to enable gripping of the supporting projection by the base gripping part. The supporting projection is further preferably arranged on the base part underneath the quick-change tool holder receptacle or in the area between the assembly region or bottom of the base part and the inlet of the quick-change tool holder receptacle into which the quick-change tool holder is inserted.

During the operation of generic quick-change tool holder systems it is found that, in particular, wear effects as a result of tribocorrosion between the base part and the quick-change tool holder appreciably restrict the usage time of such quick-change tool holder systems. For this reason, it is advantageous if the base part and the quick-change tool holder inserted in the base part are torque-proof relative to one another. This is achieved particularly advantageously in the present case by a corresponding configuration of the base gripping part and the supporting projection which are preferably configured in such a manner with respect to one another that the quick-change tool holder is mounted in a torque-proof manner on the base part. This is achieved in particular with a base gripping part and a supporting projection whose contact surfaces are not coaxial to a possible axis of rotation of the quick-change tool holder with respect to the base part, for example, about the longitudinal axis and/or the axis along the direction of insertion of the quick-change tool holder into the base part (hereinafter designated as axis of insertion). Alternatively or additionally, corresponding stops acting unilaterally or bilaterally in the direction of rotation can be provided, which are preferably arranged in the base gripping part or with the corresponding opposite side in the supporting projection. Another alternative can, for example, be locking elements such as, for example, detents which project into corresponding recesses, etc., in the respectively opposite component in the inserted state of the quick-change tool holder in the base part.

In order to achieve the preceding interactions between the base gripping part and the supporting projection, in principle a broad range of specific embodiments can be used. It is essential that the base gripping part can embrace the supporting projection, that the base gripping part can be inserted into this embracing position and that the base gripping part can be supported on the supporting projection in the inserted state, at least when forces are acting obliquely on the cutting tool in working operation. From the production engineering viewpoint, it has proved to be advantageous if the base gripping part has an angled profile. The profile thereby designates a plane of intersection through the base gripping part along the axis of insertion and in the direction of projection of the base gripping part. With an angled profile, therefore at least two straight lines meet, as is the case in a rectangle for example. Such a profile is then achieved, for example, if the base gripping part is a stop bar arranged askew to the axis of insertion of the quick-change tool holder.

The supporting projection should substantially provide a possibility for embracing for the base gripping part and at the same time be suitable for absorbing force as soon as the quick-change tool holder is supported with the base gripping part on the supporting projection. The supporting projection can specifically comprise a region of the base part projecting contrary to the direction of insertion. This can, for example, be part of a groove inserted in the base part, wherein the base gripping part projects into the groove in this embodiment in the inserted state.

The contact surface of the supporting projection, i.e., the side of the supporting projection facing away from the quick-change tool holder receptacle of the quick-change tool holder, preferably runs in the direction of insertion, i.e., the contact side/surface of the base gripping part on the supporting projection of the base part runs in the radial direction to the longitudinal axis of the quick-change tool holder receptacle obliquely to the longitudinal axis of the quick-change tool holder receptacle. In this embodiment, this side of the supporting projection and the longitudinal axis of the quick-change tool holder receptacle therefore run towards one another and intersect in their respective extensions at an angle greater than 0°, in particular in the range of greater than 0° to 15°, most preferably in a range of 2° to 10° in the direction of insertion. The angle is determined in the plane in which the longitudinal axis of the quick-change tool holder receptacle lies and in which the base part projects in the radial direction, i.e., it corresponds to the angle in the plane perpendicular to the axis of rotation of a milling machine with such a quick-change tool holder system. The angle information therefore relates to a side sectional plane through the quick-change tool holder system at the height of the longitudinal axis of the quick-change tool holder receptacle so that the longitudinal axis lies in the cutting plane. The contact or impact surface of the base gripping part thus lies obliquely to the longitudinal axis of the cutting tool receptacle, i.e., to the axis of rotation of the cutting tool, and intersects with this longitudinal axis in an area behind the base gripping part in the direction of the axis. The angled configuration is particularly advantageous when the bearing body of the quick-change tool holder is conically shaped, at least in the region in which it is surrounded by the quick-change tool holder receptacle and the quick-change tool holder receptacle also has a conical profile. In order for the quick-change tool holder to remain insertable, it is furthermore necessary for this embodiment that the insertion slope or insertion edge on which the quick-change tool holder is pushed into the quick-change tool holder receptacle in the base part ideally runs in this section rectilinearly parallel to the side of the supporting projection facing away from the quick-change tool holder receptacle. This edge therefore also runs obliquely to the longitudinal axis and preferably parallel to the outer lying side of the supporting projection in the radial direction (radial direction relates, unless expressly specified otherwise, to the longitudinal axis of the cutting tool receptacle in the quick-change tool holder). A conical design of the quick-change tool holder and the formation of the quick-change tool holder receptacle as a complementary conical bore is also particularly well suited for this purpose. In this case, the cone of the quick-change tool holder can be inserted into the quick-change tool holder receptacle in such a manner that it slides with its wall region lying on the side of the base gripping part along the wall surface lying on the side of the side projection in the interior of the quick-change tool holder receptacle and in this way is inserted into its final position. In this embodiment, however, the quick-change tool holder cannot be inserted into the base part with its conical longitudinal axis on the longitudinal axis of the quick-change tool holder since the base gripping part then impacts against the supporting projection before it has reached its embracing position. On the contrary, it must be guided on the parallel running insertion edge along the corresponding inner wall of the quick-change tool holder receptacle. In this way, in the other direction, in the direction of the longitudinal axis of the quick-change tool holder receptacle or in the direction of the axis of the quick-change tool holder receptacle in which the smallest possible distances from the wall of the quick-change tool holder receptacle exist in the radial direction on all sides, a type of undercut is achieved by the base projection embracing the supporting projection, which additionally stabilises the mounting of the quick-change tool holder in the base part.

Particularly robust and compact quick-change tool holder systems can be obtained if the quick-change tool holder and the base part are configured in such a manner that the longitudinal axis of the quick-change tool holder receptacle is parallel or in particular coaxial to the longitudinal axis of the cutting tool receptacle. In this embodiment the cutting tool is therefore inserted into the cutting tool receptacle and the quick-change tool holder into the quick-change tool holder receptacle in the same direction and preferably even on the same axis in relation to the base part.

Alternatively, the object is solved with a quick-change tool holder system comprising a base part with a quick-change tool holder receptacle and a quick-change tool holder configured to be held in the quick-change tool holder receptacle having a cutting tool receptacle, wherein the quick-change tool holder has a bearing body and a base gripping part projecting from the bearing body, which can be brought into engagement with a supporting projection arranged on the base part by means of an insertion and turning movement. This embodiment and the further developments attributed to this are hereinafter designated as "insertion and screw-in variant". The essential feature of this embodiment therefore again lies in the special configuration of the base gripping part in relation to the supporting projection. With regard to the basic structure, reference is therefore made to the preceding explanations and merely the differences of the "insertion and screw-in variant" from the "screw-in variant" are explained in detail. In principle the quick-change tool holder system of this embodiment comprises a base part having a quick-change tool holder receptacle and quick-change tool holder having a cutting tool receptacle configured for receipt in the quick-change tool holder receptacle. Unlike the preceding variant of the present invention, the quick-change tool holder which also comprises a bearing body and a base gripping part projecting from the bearing body can be brought into engagement with a supporting projection arranged on the base part by means of a combined insertion and turning movement. The mounting of the supporting projection in the base part is therefore accomplished by means of a combined movement sequence with an, in particular linear, insertion component and an, in particular rotational about the longitudinal axis of the quick-change tool holder receptacle, turning component. The turning movement is preferably accomplished about the longitudinal axis of the cutting tool receptacle and/or about the longitudinal axis of the quick-change tool holder receptacle in the base part. With this embodiment it is possible to secure the quick-change tool holder even better on the base part in the longitudinal direction, as is explained in detail hereinafter. The difference from the preceding embodiment therefore lies in the fact that quick-change tool holder can be introduced into the base part not only by means of an insertion movement but requires a combined turning and insertion movement. In principle, it is possible that the base part and the quick-change tool holder are configured in relation to one another such that the quick-change tool holder can be introduced into the base part with a movement sequence in which the insertion movement and the turning movement take place simultaneously, at least at times. It is preferable, however, if the insertion movement and the turning movement take place successively, in particular in such a manner that, when introducing the quick-change tool holder into the base part, the insertion movement takes place first and then the screwing-in movement up until the end position of the quick-change tool holder on the base part. The distinctive feature of this embodiment is that the contact surface of the base gripping part is not configured as a plane, but is bent around an axis, e.g., in the form of the cut-out surface of a cone. This contact surface, however, also intersects in the axial direction with the longitudinal axis of the cutting tool receptacle of the quick-change tool holder, i.e., with the longitudinal axis or axis of rotation of the round-shank pick mounted in the quick-change tool holder, in particular at an angle >0°, especially in the range of greater than 0° to 15°, and most preferably 2° to 10°. Reference is made in this connection to the statements made above concerning the insertion variant.

The quick-change tool holder and the base part are therefore preferably interconnected in the manner of a bayonet closure. In this embodiment the base gripping section and the supporting projection are configured in such a manner that for insertion of the quick-change tool holder into the base part, the turning movement is accomplished after the insertion movement (and in the reverse order for removal). The embracing of the supporting projection by the base gripping part is therefore achieved in particular by a screwing of the quick-change tool holder with respect to the base part, preferably with a turning movement by less than 60°, particularly less than 50° and most preferably less than 45°. When screwed into the base part, or when the base gripping part embraces the supporting projection, the quick-change tool holder can no longer be removed from the base part in a linearly directed movement and is therefore additionally secured in the base part.

Specifically the supporting projection in this variant can be configured, for example, as an arc-shaped groove segment into which the base gripping part can be screwed. To this end the base gripping part is configured in the form of a bolt. For stability reasons, however, it is ideal if the base-gripping part is designed in the form of a bent bar which engages the surfaces of the aforesaid arc-shaped groove segment.

Mounting of the quick-change tool holder in the base part is made substantially easier if an insertion stop is provided which limits the turning movement of the quick-change tool holder with respect to the base part in the screw-in direction. In this embodiment the installer must therefore turn the quick-change tool holder towards the insertion stop. It is then ensured that the quick-change tool holder has adopted its correct inserted position. Preferably a rotary stop can be present in the opposite direction. This facilitates detachment insofar as, in order to be disengaged from the base part, the quick-change tool holder must initially be turned until it hits the counterstop and then removed from the base part.

The following explanations relate to both the "insertion variant" and to the "insertion and screw-in variant".

In principle it is advantageous for the various preceding quick-change tool holders according to the present invention if the supporting projection has an insertion stop which is configured in such a manner that it limits the insertion movement of the supporting projection quick-change tool holder into the base part in the insertion direction. In this case, depending on the embodiment, the insertion stop can, for example, be achieved by the conical formation of the region of the quick-change tool holder mounted in the base part. As soon as the cone with its side wall is in contact or comes into contact with the quick-change tool holder receptacle in the base part, it does not slide, at least when it is not stressed, further into the quick-change tool holder receptacle. Additionally or alternatively, it is possible that the bearing body has an exterior stop projecting in the radial direction, in particular an annular stop or a stop running around the bearing body in an annular manner, which strikes against the front end of the quick-change tool holder receptacle. To this end, the front end of the quick-change tool holder receptacle is configured, for example, as a hollow-cylindrical projection which projects over the other body of the base part contrary to the direction of insertion. In this embodiment, the supporting projection is further preferably integrated in this projection and the base gripping part is further preferably configured as part of this annular stop. Alternatively or additionally, the base gripping part can also finally impact against the supporting projection in such a manner that it limits the extent of the insertion movement of the quick-change tool holder in the base part. To this end the base gripping part impacts either with its front side projecting in the direction of insertion against the bottom of the supporting projection or with its inner surface offset towards the rear in the direction of insertion against the top region of the supporting projection, i.e., the part projecting in the direction contrary to the direction of insertion.

In the various quick-change tool holder systems according to the present invention, it is generally possible to hold the quick-change tool holder in the base part by means of a tight fit or press fit. For dismounting it is initially necessary to overcome or to release this tight fit, for example, with the aid of hammer blows in the direction of expulsion. Alternatively, however, it is also possible to secure the quick-change tool holder inserted into the base part using a securing device. Such a securing device can, for example, be a connecting screw between the base part and the quick-change tool holder. Alternatively, a clamping sleeve or a securing bolt can also be used. It is furthermore essential that the securing device is arranged in such a manner that it acts in a direction transverse to the direction of insertion of the quick-change tool holder in the base part. In this way, possible tension and compressive loads acting in or opposite the direction of insertion of the quick-change tool holder in the base part do not act on the securing device so that stress is reduced. The securing device allows the quick-change tool holder to be held in the base part without a press fit being required. This facilitates mounting and dismounting of the quick-change tool holder on and from the base part.

The bearing body is preferably conical or cylindrically shaped. The cone in this case tapers in the direction of insertion of the quick-change tool holder into the base part. A conical bearing bolt has the advantage that it is ideally held by the base part in the area of the entire conical surface resting in the quick-change tool holder receptacle. This results in a particularly stable positioning of the quick-change tool holder in the base part. The cylindrical configuration is advantageous insofar as it can be manufactured comparatively easily and is ideal for the manufacture of a robust tight fit. Both shapes are further advantageous in that they allow a uniform rotation of the quick-change tool holder with respect to the base part about the cylinder axis or cone axis. This is particularly advantageous for the embodiment of the present invention in which the mounting of the quick-change tool holder on the base part is accomplished by means of a combined insertion and turning movement of the quick-change tool holder with respect to the base part. In addition to the preferred cylindrical or conical configuration of the bearing body, however, other shapes of the bearing body are also possible in principle such as, for example, a rectangular or pyramid-shaped form, forms having oval or polygonal cross-sections, etc. What is important for the shape of the bearing body is that it can be inserted into the quick-change tool holder receptacle and, depending on the embodiment, can be screwed in.

Ideally the quick-change tool holder system has an access opening lying in the rear area of the base part to allow access to the quick-change tool holder from the back or contrary to the direction of insertion. It is further preferred that a corresponding access opening is provided in the quick-change tool holder so that the cutting tool receptacle is also accessible from the rear area of the base part. In this way a cutting tool plugged into the cutting tool receptacle can be expelled from the back of the quick-change tool holder system, for example, using a suitable expelling tool without needing to dismount the quick-change tool holder system for this purpose. In these embodiments, the access opening in the quick-change tool holder and the access opening in the base part preferably lay one above the other so that they form a common passage from outside into the cutting tool receptacle. This access opening is further preferably configured such that it points outwards in relation to the base surface or mounting surface of the base part. When mounted in a milling machine, the access openings of the individual quick-change tool holder systems are then arranged in an outward lying manner and can be kept clean, for example, by spray water. This counteracts clogging of the access opening with dirt and wear, which also makes it easier to handle the quick-change tool holder system.

Both the base part and the quick-change tool holder are preferably designed to be solid, for example, as forged or cast parts.

In order to further minimize or prevent the entry of dirt into the fitting region between the quick-change tool holder and the base part, it is possible to provide a separate seal of the fitting region. Such a seal can be achieved, for example, with the aid of a suitable O-ring which is arranged in particular at the height of the entry region of the quick-change tool holder into the quick-change tool holder receptacle of the base part. In this case, the seal in other words seals the fitting region on the insertion side of the quick-change tool holder receptacle or at the "front" end of the quick-change tool holder receptacle. The "front" end of the quick-change tool holder receptacle corresponds to the entrance of the quick-change tool holder receptacle in the base part located closer to the base gripping part. Alternatively or additionally, a seal of the fitting regions can be provided at the "rear" end. In practice it has been shown that a seal only at the front end is especially suitable for a conically shaped fitting region and a seal on both sides is especially suitable for a cylindrically shaped fitting region.

It is generally possible that the quick-change tool holder and the base part are configured in such a manner with respect to one another that in the mounted state in the base part, the quick-change tool holder has its base gripping part directly extensively in contact with the supporting projection of the base part, in particular in the radial direction relative to the longitudinal axis of the quick-change tool holder receptacle. However, this requires extreme precision particularly when manufacturing and when installing the quick-change tool holder in the base part. It is therefore ideal if, at least in the radial direction relative to the longitudinal axis of the quick-change tool holder receptacle or parallel thereto, a gap is provided between the base gripping part and the supporting projection, in particular in the range of >0 mm to 0.5 mm and in particular 0.05 mm to 0.5 mm, in each case relative to the radial direction or the corresponding parallel. There is thus a slight clearance between the base gripping part and the supporting projection which appreciably facilitates installation. At the same time, the gap is so small that even relatively small deformations of the quick-change tool holder contrary to the radial direction press the base gripping part against the supporting projection and thereby press the base gripping part to rest on the supporting projection, whereby a relief of the quick-change tool holder is ensured early in the event of stress.

The surfaces lying facing one another or obliquely or parallel to the direction of insertion between the base gripping part and the supporting projection in the radial direction to the longitudinal axis of the quick-change tool holder receptacle can in principle be configured to run parallel to one another. If a previously specified gap is provided in this case, however, the inner surface of the base gripping part, for example in the event of stress, is pressed onto the outer and opposite surface of the supporting projection in the radial direction, which ultimately results in a punctual or linear contacting and therefore a high level of stress in the contact region. It is therefore preferable if these opposite surfaces are at an angle to one another in the unstressed state, the angle preferably being determined in such a manner that, in the event of stress, the base gripping part comes to rest with its contact surface facing the supporting projection in the radial direction against the corresponding contact surface on the supporting projection in order to enable an ideal relief of the quick-change tool holder.

In principle, suitable pastes and greases can additionally be used in the fitting region between the quick-change tool holder and the base part to improve the robustness of the quick-change tool holder system in terms of wear still further. Moreover, it is fundamentally advantageous if the contact surfaces between the base part and the quick-change tool holder are configured to be as flush as possible.

BRIEF DESCRIPTION OF THE DRAWINGS

The present invention is explained further hereinafter with reference to two exemplary embodiments. In the figures, shown schematically:

FIG. 1 shows a quick-change tool holder system in a perspective view obliquely from the front left in a first embodiment;

FIG. 2 shows the quick-change tool holder system from FIG. 1 viewed obliquely from the front left with part of the quick-change tool holder removed;

DETAILED DESCRIPTION OF THE INVENTION

Figure 3:
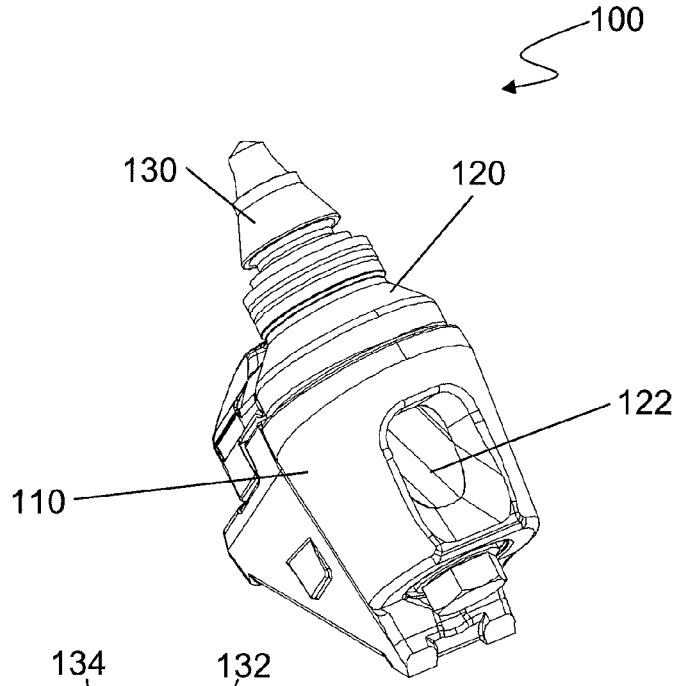
FIG. 3 shows a view of the quick-change tool holder system from FIGS. 1 and 2 obliquely from behind.

Components which are structurally identical and have the same function are provided with the same reference numbers in the following figures. FIGS. 1 to 5 and 11 relate to exemplary embodiments for the insertion variant of the present invention and are provided with reference numbers in the 100 range. FIGS. 6 to 10 and 12 relate to exemplary embodiments for the combined insertion and screw-in variant of the present invention and are characterised by reference numbers in the 200 range. Components having the same function and/or which are structurally identical are specified with corresponding reference numbers in the single- and two-digit range and for clarity are not specified in detail for each embodiment. The reference number 110 (base part) of the insertion variant therefore corresponds to reference number 210 (base part) of the insertion and screw-in variant, etc. Recurring components are also not characterised separately in each figure.

FIG. 1 relates to a quick-change tool holder system 100 having a base part 110 and a quick-change tool holder 120. A cutting tool 130 which is designed as a so-called round-shank pick is further provided in FIG. 1 as a tool for ground preparation. A plurality of such quick-change tool holder systems 100 are attached to a cylindrical roller for use and are brought into rotation in the working direction AR in working deployment. FIGS. 1 to 4 and 11 illustrate the structure and the functioning of the quick-change tool holder system 100 and will be explained in detail jointly hereinafter.

In FIGS. 1, 2, 3 and 4, the cutting tool 130 comprises a cylindrical bearing shaft 131 and a cutting tool head 132 having a contact or stop surface 133 pointing towards the quick-change tool holder 120 and a cutting tool top 134 pointing away from the quick-change tool holder 120. The cutting tool 130 is arranged in the quick-change tool holder 120 and is held by the same. For this purpose, the quick-change tool holder 120 has a cylindrical cutting tool receptacle 121 which extends from the cutting tool insertion or the annular cutting tool stop surface 122 linearly along the longitudinal axis A1 of the quick-change tool holder 120. The longitudinal axis A1 of the quick-change tool holder 120 is therefore by definition defined by the longitudinal axis of the cutting tool receptacle 121, i.e., by the coaxial axis of rotation A1 of the round-shaft pick 130 inserted in the cutting tool receptacle 121. In the cutting tool receptacle 121 the cutting tool 130 is braced by means of a clamping sleeve 135 with the inner wall of the cutting tool receptacle 121. The cutting tool receptacle 121 opens to the rear into an outlet opening 122 which is open to the outside of the quick-change tool holder system 100 and makes a connection from the rear side of the cutting tool 130 mounted in the cutting tool receptacle 121 to the external surroundings of the quick-change tool holder system 100. Through the outlet hole, access to the front end of the cutting tool 130 accommodated in the cutting tool receptacle 121 is possible, for example, for dismounting purposes.

The cutting tool receptacle 121 is part of a bearing body 123 of the quick-change tool holder 120, which, in the axial direction of the longitudinal axis A1 of the cutting tool receptacle 121, initially has a conical rear region mounted in the base part 110 and a protruding front region. The bearing body 123 is therefore overall configured to extend longitudinally along the axis A1. The cylinder axis of the cutting tool 130 and the longitudinal axis A1 of the cutting tool receptacle 121 are thus coaxial. In addition to the bearing body 123, the quick-change tool holder 120 comprises a base gripping part 126 which projects outwards in relation to the axis A1 in the radial direction and comprise a bridge region 127 and a gripping arm 128. The base gripping part 126 therefore projects outwards in the radial direction in relation to the longitudinal axis A of the bearing part 123 and has in its end region a gripping arm 128 that is protruding and bent or curved in the direction of insertion. A receiving space is thereby formed between the gripping arm 128 and the outer wall of the bearing part 123 opposite, in which a supporting projection 111 of the base part 110 is received when inserting the quick-change tool holder 120 into the base part 110. This region is thus altogether configured more or less in the shape of a U, wherein the gripping arm 128 forms one side of this U profile and has a contact surface 180 on its inner side.

An essential component of the base part is therefore the supporting projection 111, which is part of a groove 112 running transversely over the base part 110 in the present case. The base part 110 further has a mounting region 113 with fastening feet lying on its underside, by means of which the base part 110 is welded on, for example, a cylinder body of a milling machine. The connection to the respective supporting element of the working device is thus made via the mounting surface 113. The base gripping part 126 protrudes in relation to the axes A1, A2 or A3 in the radial direction in the direction of the mounting region 113 and the gripping arm 128 is bent in the direction of insertion.

A quick-change tool holder receptacle 114 is further provided in the base part 110, which is configured to receive the rear region 124 of the bearing body 123. The quick-change tool holder receptacle 124 is also configured to be substantially (hollow) conical or complementary to the conical region of the quick-change tool holder 120 and forms a receptacle in this region into which the bearing body 123 comes to rest partially or completely in the inserted state. An outlet opening 115 is further provided in the rear region of the base part 110 in relation to the working direction AR of the cutting tool 130, which opening opens from the outside into the outlet hole 122 in the quick-change tool holder 120 so that the rear side of the cutting tool 130 introduced into the cutting tool receptacle 121 is accessible from the outside through the outlet opening 115 and the outlet opening 122. Thus, for example, an expulsion pressure can be applied to the end of the cutting tool 130 for pushing out the cutting tool 130 in the direction opposite to the direction of insertion C of the cutting tool 130 from the cutting tool receptacle 121. In the present exemplary embodiment (and also in the further exemplary embodiments) the direction of insertion C of the cutting tool 130 lies on the longitudinal axis of the cutting tool receptacle 121.

Figure 4:
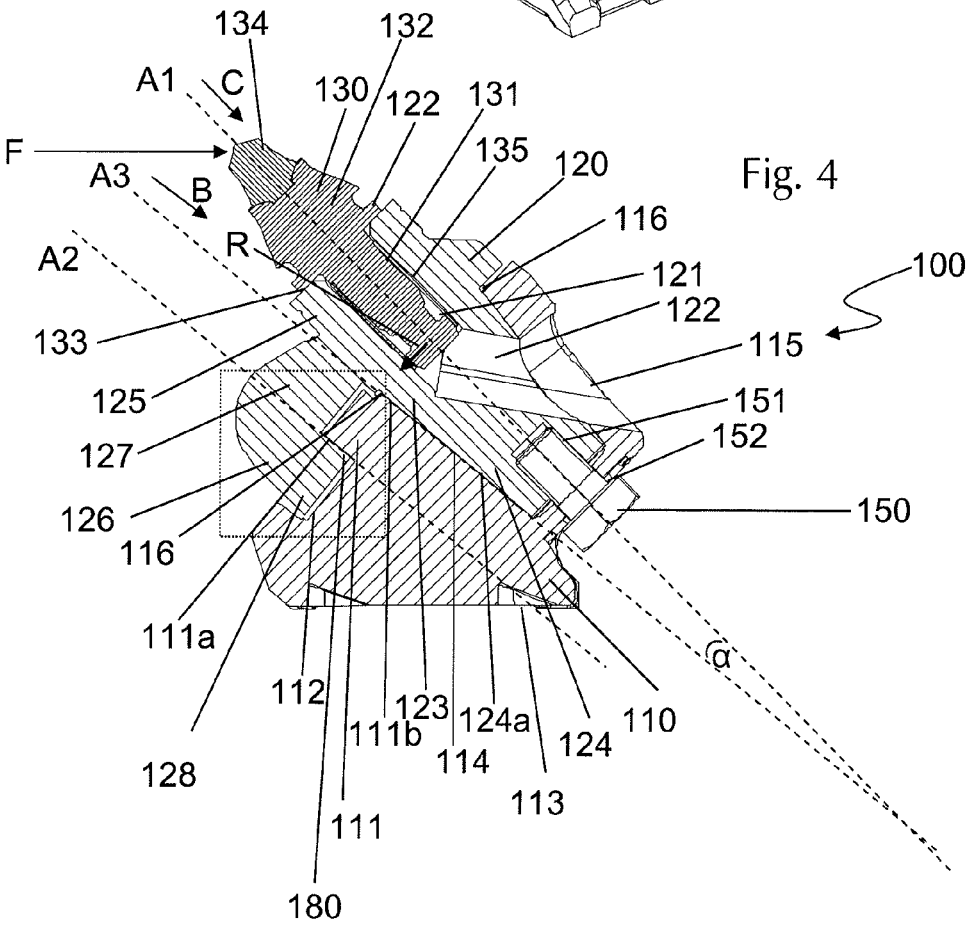
FIG. 4 shows a longitudinal section through the quick-change tool holder system from FIGS. 1 to 3.
Figure 11:
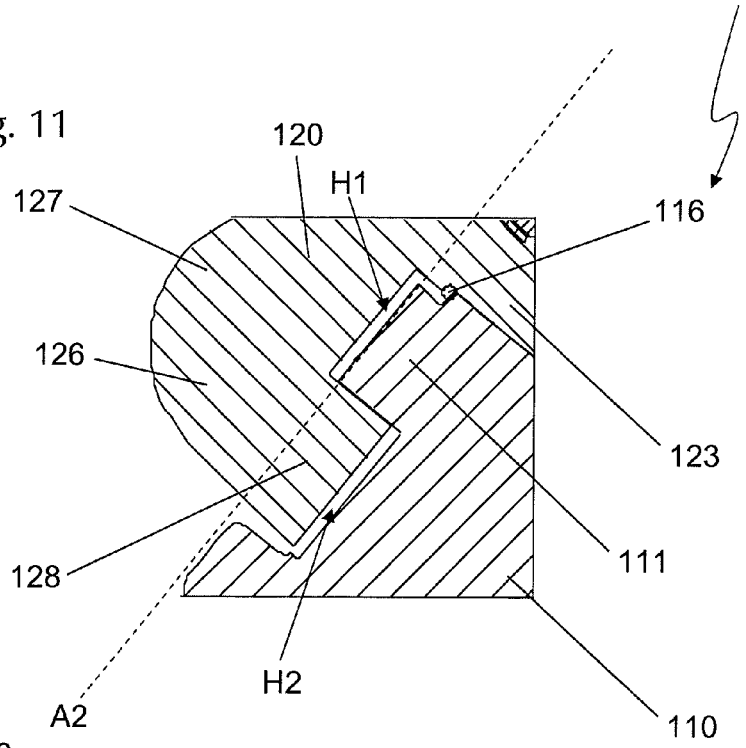
FIG. 11 shows a cut-out enlargement of the embracing region from FIG. 4.

In order to install the quick-change tool holder 120 in the base part 110, the quick-change tool holder 120 is inserted in the direction of insertion B, as shown in FIG. 2. The base gripping part 126 is thereby pushed onto the base part 110 and embraces the supporting projection 111 in the radial direction to the longitudinal axis A1 of the quick-change tool holder receptacle 114. Embrace therefore means in the present case that the base gripping part 126 and the corresponding region of the bearing body 123 lie on both sides of the supporting projection 111 [on the two opposite sides 111*a* (outer side of the supporting projection 111 in the radial direction R) in the radial direction in relation to the longitudinal axis A1 and 111*b* (inner side of the supporting projection 111 in the radial direction)] and enclose the supporting projection 111 in sandwich fashion in this region. To this end it is not absolutely necessary that the base gripping part 126 comes to rest on both sides 111*a* and 111*b*, as shown in FIG. 4 for example.

The outer side of the supporting projection 111 in the radial direction further runs in the axial direction obliquely to the longitudinal axis A1 of the cutting tool receptacle in the quick-change tool holder. This side is configured as a planar contact surface for the base gripping part 128 and the contact surface 180. In the longitudinal sectional plane in FIG. 4, the longitudinal axis A1 and the longitudinal axis A2 of the wall 111*a*, or the inner edge 124*a* of the rear region of the bearing body 123 running parallel thereto, lie at an angle $\alpha$ to the axis A3 (corresponds to the axis of insertion) with respect to one another. This special design has the advantage that the supporting projection 126 is not configured at right angles but undercut in relation to the outer side wall 111*a* in the direction of insertion C and therefore forms a hook-type securing device in the longitudinal direction A1 of the cutting tool receptacle. In order to install the quick-change tool holder 120 into the base part 110, it is therefore necessary to insert the quick-change tool holder 120 resting on the mounting edge A3 in the direction B into the base part 110.

The quick-change tool holder 120 is furthermore fixed on the base part 110 such that it cannot be turned. A prevention of the turning of the quick-change tool holder 120 is also ensured by the gripping arm 128 embracing the supporting projection 111 with its base gripping part 126 in the inserted state, which in the inserted state relative to the cone axis A1 or the longitudinal axis of the quick-change tool holder 120 in the radial direction, is comparable to a passant relative to the cutting tool receptacle 121 configured to be circular in the radial plane, which is interlocked with the base gripping part 126. The rotational movement is thus blocked in this plane and the quick-change tool holder 120 is mounted in fashion that is secure against turning about the axis A1 with respect to the base part 110.

The extent of the insertion movement is limited by the abutment of the cone outer surface of the rear region 124 of the bearing body 123 against the cone inner wall of the base part 110 in the quick-change tool holder receptacle 114. This space is outwardly sealed by a seal, specifically the O-ring seal 116. In contrast, the quick-change tool holder 120 does not come to abut the base part 110 directly, neither with its base gripping part 126 nor with the front end of the bearing body 123, so that settling can occur in the direction of insertion B during working operation. For this reason, the free spaces H1 and H2 are provided in the direction of insertion in these regions between the base part 110 and the quick-change tool holder 120. In order to prevent slippage of the quick-change tool holder 120 from the base part 110 and ensure a reliable mounting, a screw 150 is therefore provided which is screwed through a suitable hole in the base part 110 into an internal thread region 151 in the quick-change tool holder 120 from behind. The longitudinal axis of the screw thereby lies coaxially to the longitudinal axis A1. In the axial direction A1, the screw connection with the screw 150 is further cushioned by a spring washer 152 so that any settling that may occur in the direction of insertion B or in the axial direction C during operation is compensated.

Wedge surfaces descending centrosymmetrically to the mounting region 113 are arranged in the base part 110 and in the quick-change tool holder 120, whereby a better guidance of the milled material is brought about. The arrangement as a whole is designated as a material guiding region, which comprises a part 129 on the quick-change tool holder side and a part 119 on the base part side.

An essential advantage of the quick-change tool holder system 110 is that the mounting of the quick-change tool holder 120 on the base part 110 is particularly simple since the quick-change tool holder 120 can be slid onto the base part in an accurately fitting manner. Correct positioning is ensured in particular by the quick-change tool holder 120 that is mounted in a fashion that is secure against turning with respect to the base part 110 by means of the base gripping part 126 embracing the supporting projection 111, which therefore overall corresponds to a restraint of the quick-change tool holder 120 in the base part 110. A further advantage is moreover that a relief of the forces acting on the quick-change tool holder is brought about by said embrace of the base gripping part. Usually, the counterforce applied to the cutting tool 130 by the subsurface to be prepared acts on the cutting tool 130 in the direction of the arrow F during working operation. This force is transmitted to the quick-change tool holder 120. A type of overload security device is thus achieved by the base gripping part 126 since some of the force F acting on the quick-change tool holder is transferred directly to the supporting projection 111 by means of the gripping arm 128. In the exemplary embodiment according to FIGS. 1 to 4, the base gripping part 126 rests with its gripping arm 128 on the supporting projection 111 in the radial direction to A2 or A3 in the direction of the quick-change tool holder 120 (to be precise, the contact surface 111*a* lies against the contact surface 180) so that stress relief or reduction occurs immediately when the cutting tool 130 is subjected to strain. The cut-out enlargement in FIG. 11, which corresponds to the dashed box in FIG. 4, illustrates this arrangement.

Figure 5:
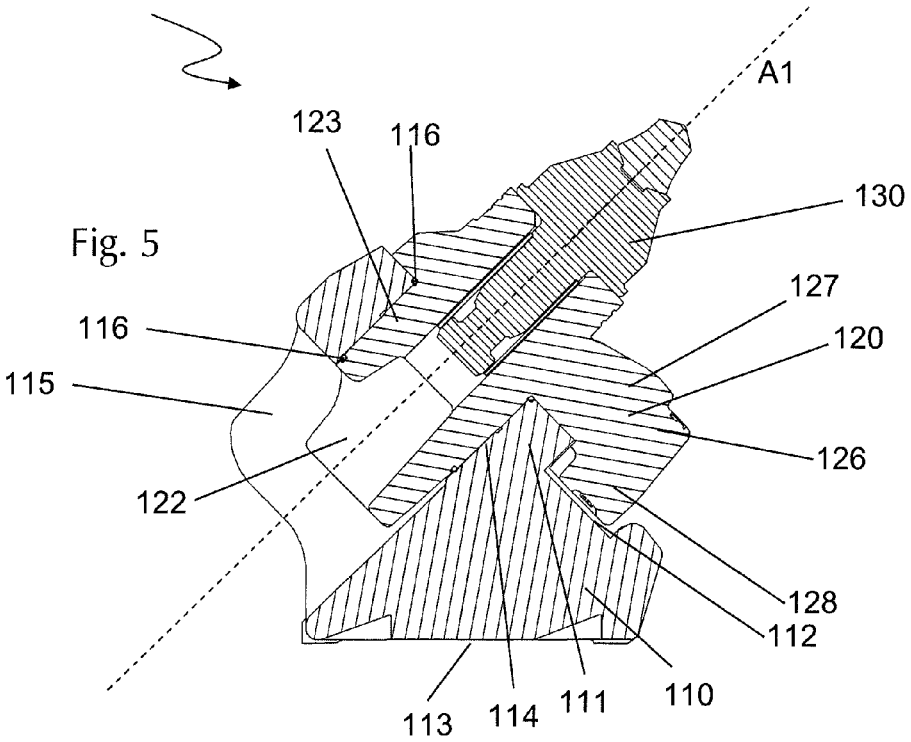
FIG. 5 shows a longitudinal section through a quick-change tool holder system in a second embodiment.
Figure 6:
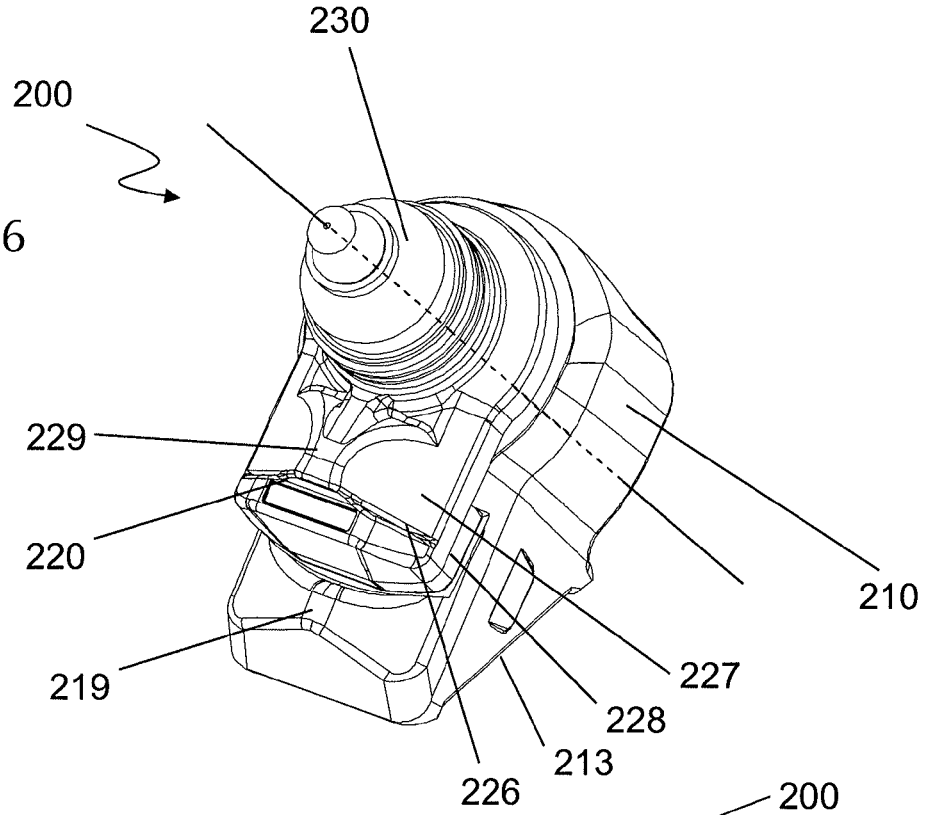
FIG. 6 shows a perspective oblique view obliquely from the front of a quick-change tool holder system in a third embodiment.

FIG. 5 shows the longitudinal section of an alternative embodiment of the quick-change tool holder system 100 from FIGS. 1 to 4, wherein components having the same structure or function are provided with the same reference numbers. The essential difference of the quick-change tool holder system 100 from FIG. 5 consists in the type of configuration of the fixing of the quick-change tool holder 120 on the base part 110 which, in contrast to the embodiment according to FIGS. 1 to 4, is achieved in FIG. 5 by a cylindrical fit, specifically a press fit. An additional securing of the quick-change tool holder 120 in the base part 110, for example, by a fixing screw is therefore not required. In the longitudinal direction two O-ring seals located one behind the other in the axial direction in relation to the axis A1 are provided.

FIGS. 6, 7, 8 and 9 show different views of another embodiment of a quick-change tool holder system 200 which corresponds in its fundamental structure to the aforesaid quick-change tool holder system. Reference is made to the previous figures for functionally corresponding components. For reasons of clarity, not every reference number introduced accordingly in FIGS. 6 to 10 is indicated again. Rather, the differences are essentially discussed and reference is made to the preceding explanations for the common features.

The essential difference of the quick-change tool holder system 200 from the quick-change tool holder system 100 lies in the formation of the base part 210 and the quick-change tool holder 220 in such a manner that the quick-change tool holder 220 can be introduced into the base part 210 in a combined insertion and turning movement. In this embodiment the embracing of the supporting projection 211 by the base gripping part 226 is not achieved merely by inserting the supporting projection quick-change tool holder into the base part or pushing the base gripping part onto the supporting projection but by a combined insertion and screw-in movement.

Specifically this is achieved in the embodiment 200 according to FIGS. 6 to 9 with the circular-segment shaped design of the base-gripping part 226 and the arc-segment shaped configuration of the groove 212. It is important for understanding the functioning of the quick-change tool holder system 200 that the circular paths of the groove 212 and that of the part of the base gripping part 226 facing the quick-change tool holder 220 run concentrically to the axis of rotation D about which the quick-change tool holder 220 is turned to engage with the base part 210 (or unscrewed for dismounting). In the quick-change tool holder system 200, the axis of rotation D is simultaneously the longitudinal axis A1 of the cutting tool receptacle 221.

Another essential detail lies in the fact that the base gripping part 226 is undercut and thus forms a hook element in the mounted state contrary to the direction of insertion B which secures the quick-change tool holder 220 with respect to its axial displacement contrary to the direction of insertion B in relation to the base part 210. This becomes clear in particular by a comparison of the position of the longitudinal axis A1, the cylindrical wall running parallel in the quick-change tool holder receptacle 214 A2 or the cylindrical region of the quick-change tool holder 220 in contact with the latter with the axis A3 running obliquely in relation thereto. The axis A3 runs along the contact surface between the region of the gripping arm 228 of the base gripping part 226 facing the quick-change tool holder 220 and the region of the supporting projection 211 facing outwards in the radial direction. The contact surface 280 present on the quick-change tool holder (220) there corresponds to a surface bent around the longitudinal axis A1, i.e., it corresponds to the cut-out surface of a cone. In the plane of the axes A1 and A3 or in the plane of intersection through the quick-change tool holder system 200 in which the axes A1 and/or A3 lie, these axes run at an angle $\alpha$ towards one another and intersect. It is therefore not possible to withdraw the quick-change tool holder 220 in its installed and screwed-in state from the base part 210 contrary to the direction of insertion B. On the contrary, this is prevented by the gripping arm 228 of the base gripping part 226 gripping behind the supporting projection 211. The quick-change tool holder 220 or the base gripping part with the base part 110 or its supporting projection thus form a type of bayonet closure.

In principle, the quick-change tool holder 220 is pivotable with respect to the base part 210 at least in the range between the state gripping behind the supporting projection 211 and the unscrewed insertion state in relation to the base part 210. Although in principle the use of pivot limits, for example in the groove 212 or on the supporting projection 211, is possible, the exemplary embodiment shown in FIGS. 6 to 9 is configured in such a manner that the quick-change tool holder 220 can be turned 360° about the axis of rotation D (which is coaxial to the axis A1) when it is in an inserted state in the base part 210.

In the present exemplary embodiment, the extent of the insertion is limited by a striking of the quick-change tool holder 220 against the annular stop of the base part 210 projecting in the axial direction, against which the quick-change tool holder impacts with a corresponding countersurface. In order to avoid an unscrewing of the gripping arm 228 of the quick-change tool holder 220 from the undercut of the supporting projection 211 of the base part 210 during operation of the quick-change tool holder system 200, an anti-turn device is also provided in the quick-change tool holder system 200. This is specifically achieved by a securing screw 250 which screws the quick-change tool holder 220 to the base part 210 perpendicular to the longitudinal axis or the axis of rotation. The screw 250 is therefore almost completely decoupled in relation to the forces acting on the quick-change tool holder transmitted by the cutting tool (apart from torsional forces of the round-shank pick 230 which may occur) and thus has a very long lifetime. For dismounting, the screw 250 must first be unscrewed and removed (direction of arrow P1). Then the quick-change tool holder 220 is unscrewed from the position in FIG. 6 in the direction of the arrow P2 from engagement of the base gripping part 126 on the supporting projection 111 and is subsequently removed from the base part 210 contrary to the direction of insertion B (for mounting in the corresponding opposite sequence). This is explained in further detail hereinafter.

Furthermore, in the exemplary embodiment of the quick-change tool holder system 200, the base part 210 and the quick-change tool holder 220 are broadly open to the rear, i.e., pointing away from the tip of the cutting tool 230, both in the axial direction and outwardly perpendicular to the axial direction and in this way, for example, also allow access to the cutting tool rear side in the cutting tool receptacle 221. This opening also facilitates the cleaning and cooling of the complete system since the cutting tool 230 and the quick-change tool holder 220 can be reached directly from behind. The cutting tool receptacle 221 is furthermore rectilinear and the quick-change tool holder is configured to be completely continuous. Similarly, the cutting tool receptacle 214 is also rectilinear and the base part 210 is configured to be completely continuous and is arranged with respect to its longitudinal axis coaxially to the cutting tool 230 and coaxially to the longitudinal axis of the cutting tool receptacle 221.

Figure 7:
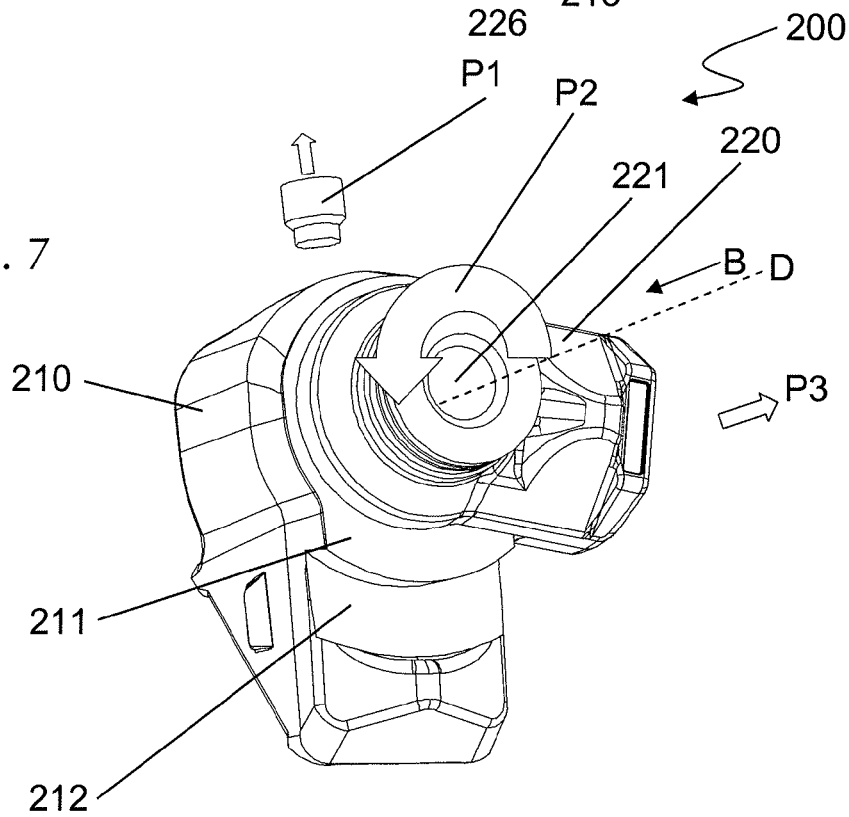
FIG. 7 shows the quick-change tool holder from FIG. 6 with the anti-rotation device removed and the quick-change tool holder unscrewed from engagement.
Figure 8:
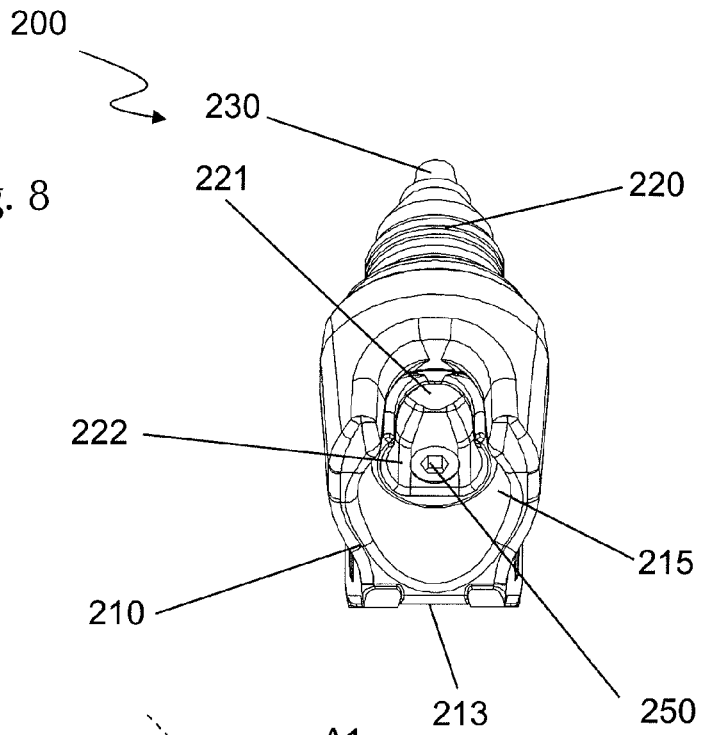
FIG. 8 shows a rear view of the quick-change tool holder system from FIG. 6.
Figure 9:
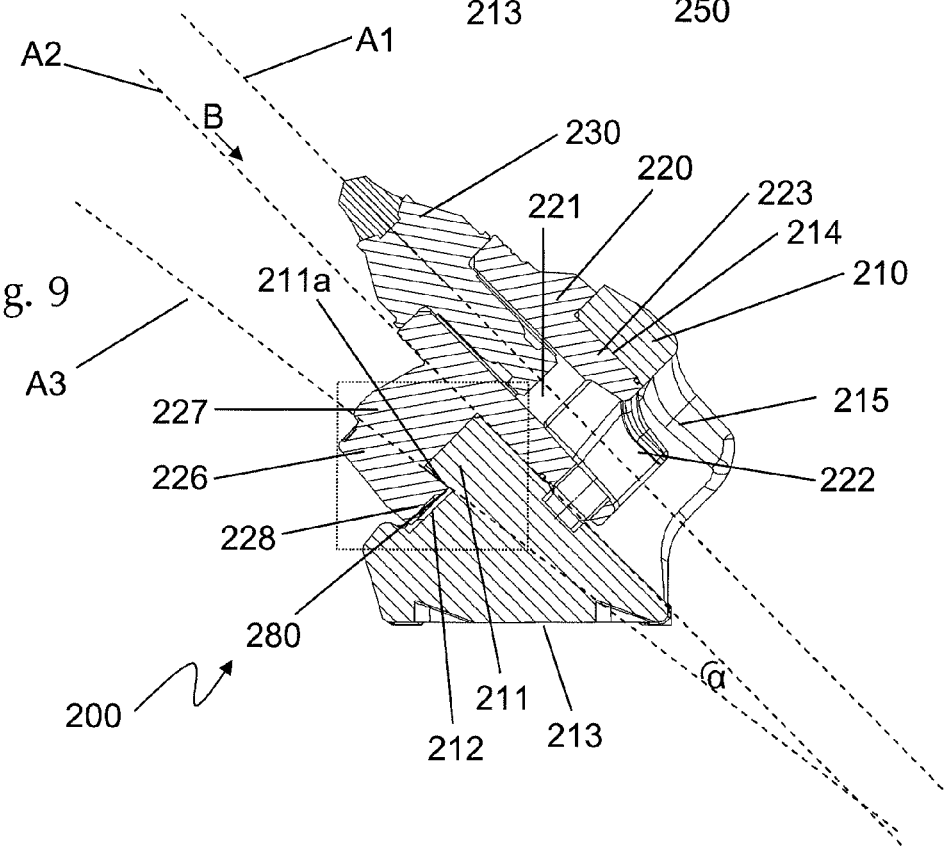
FIG. 9 shows a longitudinal view of the quick-change tool holder system from FIG. 6.

In particular FIG. 7 illustrates the essential characteristic of the embodiment of the quick-change tool holder system 200 with the connection between the base part 210 and the quick-change tool holder 220 configured in the manner of a bayonet closure. FIG. 7 shows the dismounting steps starting from the state shown in FIG. 6. Accordingly, the mounting steps for installing the quick-change tool holder 220 in the base part proceed in the reverse order. First, the fastening screw 250 is released, thus releasing the turning prevention of the quick-change tool holder 220 in relation to the base part 210 achieved with the screw 250. In a next step, the quick-change tool holder 220 can then be unscrewed from the bayonet holder about the axis of rotation D in the direction of the arrow P2. To this end, the base gripping part 226 must be twisted until it disengages from the undercut formed in the supporting projection 211. The quick-change tool holder 220 can then be withdrawn from the base part 210 in the direction of the arrow P3 or contrary to the direction of insertion of the quick-change tool holder 220 in the base part 210. This embodiment simultaneously enables the stress reduction described above with regard to exemplary embodiment 100 during operation. In this case, the force F is introduced in the direction of the arrow F into the round-shaft pick 230 and the entire quick-change tool holder 220 is thus pushed in the direction of the arrow F, which can lead to considerable stress on the components and corresponding materials. By means of the base gripping part 226, a stress reduction occurs in such a way that the contact surface 280 on the inner side of the U-shaped arm of the base gripping part 226 strikes against the countersurface 211*a* and allows a transmission of the forces of the stress F in this region.

Figure 12:
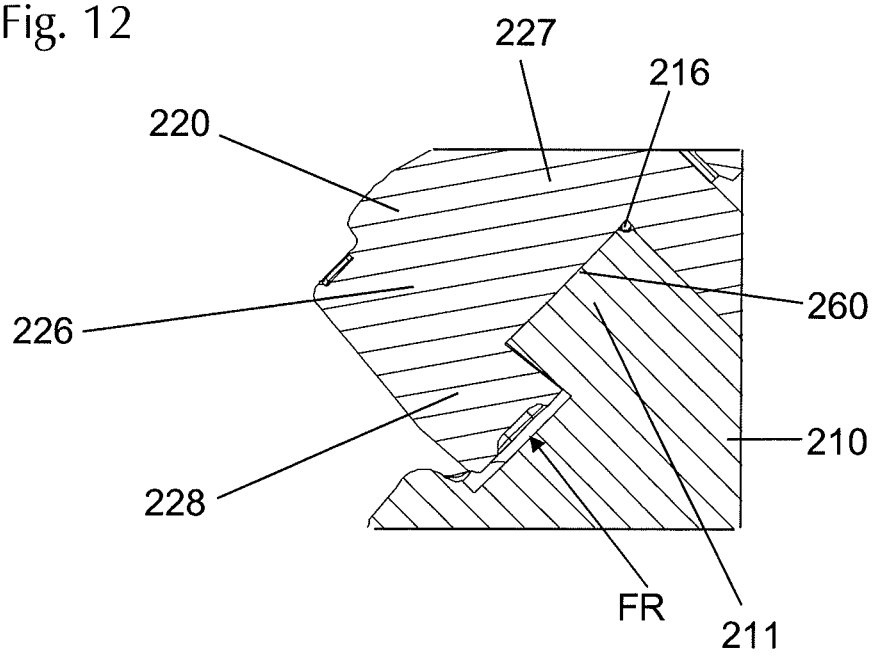
FIG. 12 shows a cut-out enlargement of the embracing region from FIG. 9.

FIG. 12 illustrates the contact relationships of the embodiment from FIGS. 6 to 9 in relation to the base gripping part 226 on the supporting projection 211. In contrast to the previous embodiments, the base gripping part 226 also rests with its bridge region 227 in the direction of insertion on the stop surface 260 of the supporting projection 211. The parallel surface in the front end region of the gripping arm 228 in the direction of insertion on the other hand is at a distance from the bottom of the groove 212 (free space FR).

Figure 10:
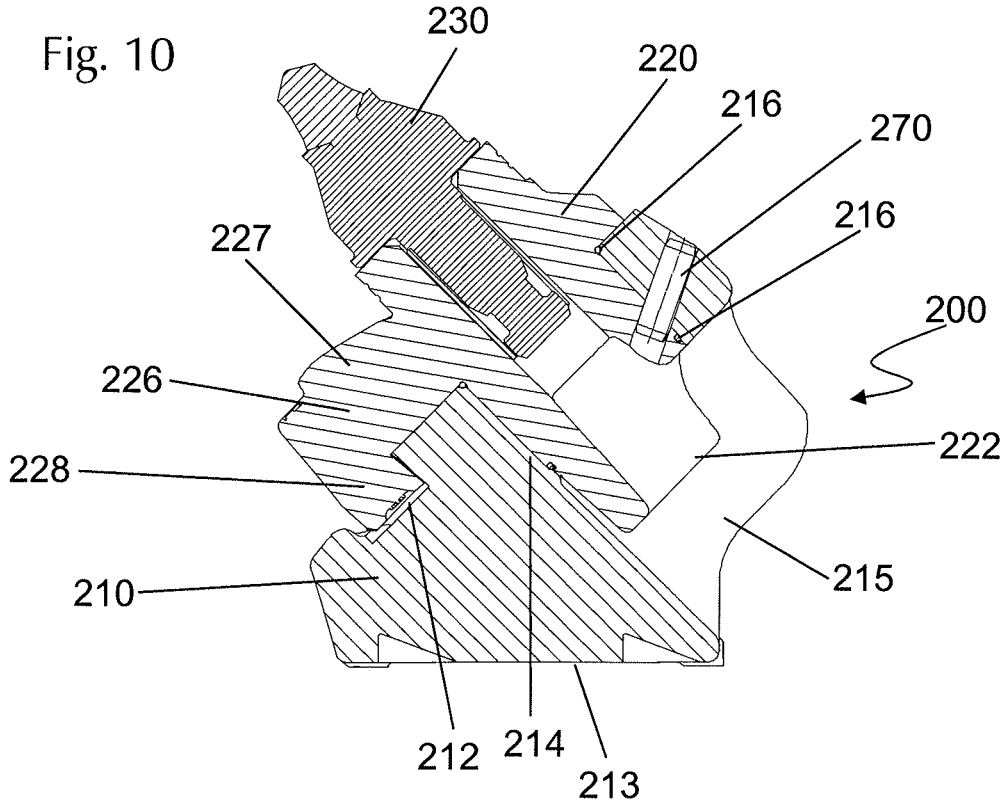
FIG. 10 shows a longitudinal section of another embodiment of a quick-change tool holder system.

Finally, FIG. 10 relates to a longitudinal sectional view of a further variant of the quick-change tool holder system 200, wherein the positioning of the anti-turn device has been varied. Instead of the internal screw 250, a clamping pin 270 attached at the top is inserted into a superposed hole 261 in the base part 210 and in the quick-change tool holder 220, likewise transverse to the axis of rotation, and thereby prevents the quick-change tool holder 220 from being able to turn with respect to the base part 210.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicants' invention.

What is claimed is:

1. A quick-change tool holder system, comprising:

a base part having a quick-change tool holder receptacle and a supporting projection having an outer side wall in a radial direction (R); and a quick-change tool holder configured for insertion into the quick-change tool holder receptacle and comprising a cutting tool receptacle configured for receiving a round-shaft pick with the cutting tool receptacle having a longitudinal axis (A1), wherein the quick-change tool holder has a bearing body and a base gripping part which protrudes radially in relation to a direction of insertion (B) of the quick-change tool holder in the base part and which projects in the direction of insertion (B), which base gripping part grips the supporting projection on the base part in an inserted state, wherein the base gripping part has a contact surface for contact with the outer side wall of the supporting projection, with the contact surface being planar and extending along an axis that runs obliquely to the longitudinal axis (A1) and intersects with the longitudinal axis (A1) at an angle ($\alpha$) of greater than 0° and up to 15°, and wherein the supporting projection is undercut in a direction of insertion (C).

2. A quick-change tool holder system according to claim 1, wherein the base gripping part and the supporting projection are configured with respect to one another in such a way that the quick-change tool holder is mounted in the base part in a non-rotatable manner.

3. A quick-change tool holder system according to claim 1, wherein the base gripping part has an angled profile.

4. A quick-change tool holder system according to claim 1, wherein the base gripping part is a stop bar arranged askew to the direction of insertion (B) of the quick-change tool holder.

5. A quick-change tool holder system according to claim 1, wherein the supporting projection is part of a groove in the base part.

6. A quick-change tool holder system according to claim 1, wherein the quick-change tool holder and the base part are configured such that the longitudinal axis of the quick-change tool holder receptacle is coaxial to the longitudinal axis of the cutting tool receptacle.

7. A quick-change tool holder system according to claim 1, wherein the supporting projection has an insertion stop.

8. A quick-change tool holder system according to claim 1, wherein a securing device is provided.

9. A quick-change tool holder system according to claim 8, wherein the securing device is a connecting screw between the base part and the quick-change tool holder.

10. A quick-change tool holder system according to claim 1, wherein the bearing body is configured in the shape of a cone.

11. A quick-change tool holder system according to claim 1, wherein the bearing body is configured in the shape of a cylinder.

12. A quick-change tool holder system according to claim 10, wherein the bearing body is sealed vis-à-vis the base part in the inserted state.

13. A quick-change tool holder system according to claim 1, wherein the quick-change tool holder and the base part exhibit an access opening via which the cutting tool receptacle is accessible from a rear area.

14. A quick-change tool holder system according to claim 11, wherein the bearing body is sealed vis-à-vis the base part in the inserted state.

* * * * *